US008608216B2

(12) United States Patent
Lunde

(10) Patent No.: US 8,608,216 B2
(45) Date of Patent: Dec. 17, 2013

(54) ELEVATOR CONNECTOR DEVICE

(75) Inventor: Ola Lunde, Hafrsfjord (NO)

(73) Assignee: Seabed Rig AS (NO)

( * ) Notice: Subject to any disclaimer, the term of this patent is extended or adjusted under 35 U.S.C. 154(b) by 0 days.

(21) Appl. No.: 13/502,448

(22) PCT Filed: Oct. 25, 2010

(86) PCT No.: PCT/NO2010/000379
§ 371 (c)(1),
(2), (4) Date: Apr. 17, 2012

(87) PCT Pub. No.: WO2011/053149
PCT Pub. Date: May 5, 2011

(65) Prior Publication Data

US 2012/0200101 A1 Aug. 9, 2012

(30) Foreign Application Priority Data

Oct. 27, 2009 (NO) ..... 20093229

(51) Int. Cl.
*B66C 1/00* (2006.01)
*E21B 19/06* (2006.01)

(52) U.S. Cl.
USPC ..... 294/90; 166/77.52

(58) Field of Classification Search
USPC ..... 294/90, 102.2, 902; 166/77.52, 77.1, 166/75.14; 175/423
See application file for complete search history.

(56) References Cited

U.S. PATENT DOCUMENTS

| | | | | |
|---|---|---|---|---|
| 1,446,568 | A | 2/1923 | Krell | |
| 1,790,388 | A | 1/1931 | Monroe et al. | |
| 3,495,864 | A * | 2/1970 | Jones et al. | 294/90 |
| 3,588,162 | A * | 6/1971 | Jones et al. | 294/90 |
| 4,522,439 | A | 6/1985 | Haney | |
| 4,715,456 | A * | 12/1987 | Poe et al. | 175/423 |
| 7,510,033 | B2 * | 3/2009 | Lutzhoft et al. | 175/423 |
| 8,002,027 | B2 * | 8/2011 | Angelle et al. | 166/77.52 |
| 2008/0216999 | A1 * | 9/2008 | Halse | 166/75.14 |

FOREIGN PATENT DOCUMENTS

| | | | |
|---|---|---|---|
| CA | 854590 | A | 10/1970 |
| GB | 491816 | A | 9/1938 |

OTHER PUBLICATIONS

Written Opinion issued in connection with PCT/N02010/000379.
International Search Report issued in connection with PCT/NO2010/000379.

* cited by examiner

*Primary Examiner* — Stephen Vu
(74) *Attorney, Agent, or Firm* — Akerman LLP

(57) ABSTRACT

An elevator connector device designed with an opening for passage of a pipe having a socket, wherein a locking jaw complementary fitting in the elevator connector is arranged to come to abutment against the socket when the pipe is lifted, and wherein the elevator connector is provided with several connected, different locking jaws fitting different pipe dimensions.

5 Claims, 4 Drawing Sheets

II-II

ELEVATOR CONNECTOR DEVICE

This application is a national phase of PCT/NO2010/000379, filed Oct. 25, 2010, and claims priority to NO 2009 3229, filed Oct. 27, 2009, the entire contents of both of which are hereby incorporated by reference.

BACKGROUND

This invention relates to an elevator connector. More particularly it concerns an elevator connector designed with an opening for passage of a pipe having a socket, a locking jaw complementary fitting in the elevator connector being arranged to be able to come to a stop against the socket when the pipe is lifted.

During work on a drill floor an elevator is often used for lifting of pipes in and at the drilling centre. The pipe with the pipe socket is first displaced through an opening in the elevator connector whereafter locking jaws are displaced into the elevator connector as shown in the patent U.S. Pat. No. 5,375,897. The locking jaws come to a stop against the pipe socket when the pipe is lifted.

Known elevator connectors having locking jaws are adapted to a certain pipe dimension. To be able to use different pipe dimensions in the same elevator connector, the elevator connector may be provided with clamping jaws arranged to be able to grip the pipe and thereby take up diameter variations.

Devices of this sort may render an uncertain connection between the elevator connector and the pipe, which is hardly acceptable during lifting operations. Unnecessary wear may also take place on the pipes in the contact area for the clamping jaws.

SUMMARY

The object of the invention is to remedy or reduce at least one of the disadvantages of the prior art.

The object is achieved in accordance with the invention by the features disclosed in the below description and in the subsequent claims.

There is provided an elevator connector having an opening for passage of a pipe having a socket, wherein a locking jaw complementary fitting in the elevator connector being arranged to be able to come to a stop against the socket when the pipe is lifted, characterised in that the elevator connector is provided with several connected, different, locking jaws fitting different pipe dimensions.

The various locking jaws are typically provided with different internal diameter where the diameter is chosen based on the relevant pipe dimensions.

At least one of the different locking jaws may be selectively displaceable between a passive, idle position and an active, working position. Change of pipe dimension may therefore be made without having to rebuild the elevator connector.

At least one of the different locking jaws is rotatable about a shaft having a central axis, the shaft being connected to the elevator connector. The locking jaw may thereby be easily rotated between its active position and its passive position.

Alternatively, for example due to space situation, at least one of the different locking jaws may be parallelly displaceable, for example by being connected to the elevator connector by means of two parallel arms. The elevator connector may be axially displaceable, for example in a guide.

The locking jaws are preferably crescent-shaped but may have any suitable shape. The different locking jaws may advantageously be designed to be built at least on or into each other. See the special part of the description.

The device according to the invention provides a considerable simplification of the work necessary for changing pipe dimension in and at the drilling centre. The device is also suitable for remote control and automation of the connecting and disconnecting operations between pipe and the elevator connector.

BRIEF DESCRIPTION OF THE DRAWINGS

In the following is described an example of a preferred embodiment illustrated in the accompanying drawings, wherein.

DETAILED DESCRIPTION

Figure 1:
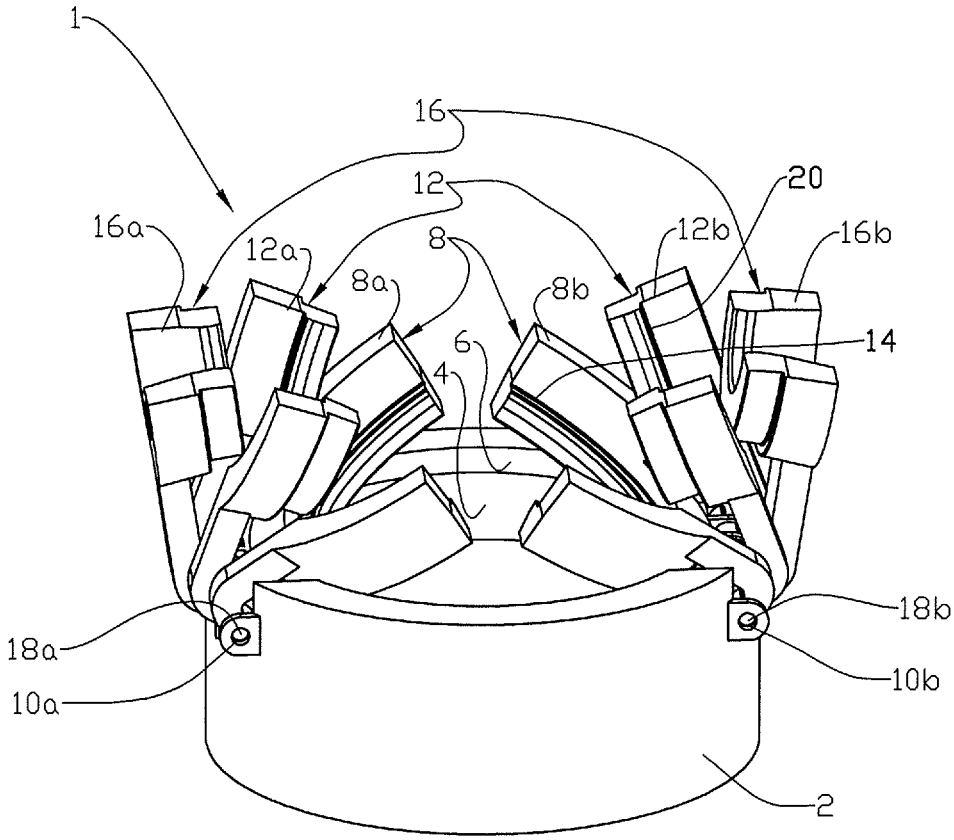
FIG. 1 is a perspective view of an elevator connector in accordance with the invention.

In the drawings the reference numeral 1 indicates an elevator connector comprising an elevator housing 2. The elevator housing 2 that is connected to a not shown lifting equipment is provided with an opening 4 therethrough, the opening 4 being provided with a conical portion 6 at its upper portion, see FIG. 4.

A first set of locking jaws 8 comprising two opposing, crescent-shaped jaws 8*a* and 8*b* is rotatably fastened to the elevator housing 2 about the shafts 10*a* and 10*b* respectively.

Figure 2:
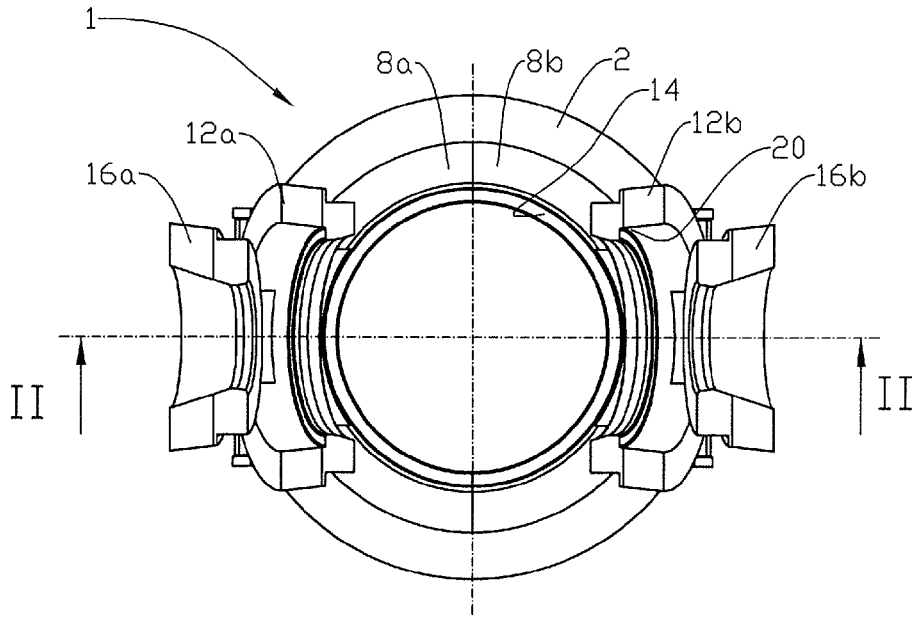
FIG. 2 shows a plan view of the elevator connector of FIG. 1.
Figure 3:
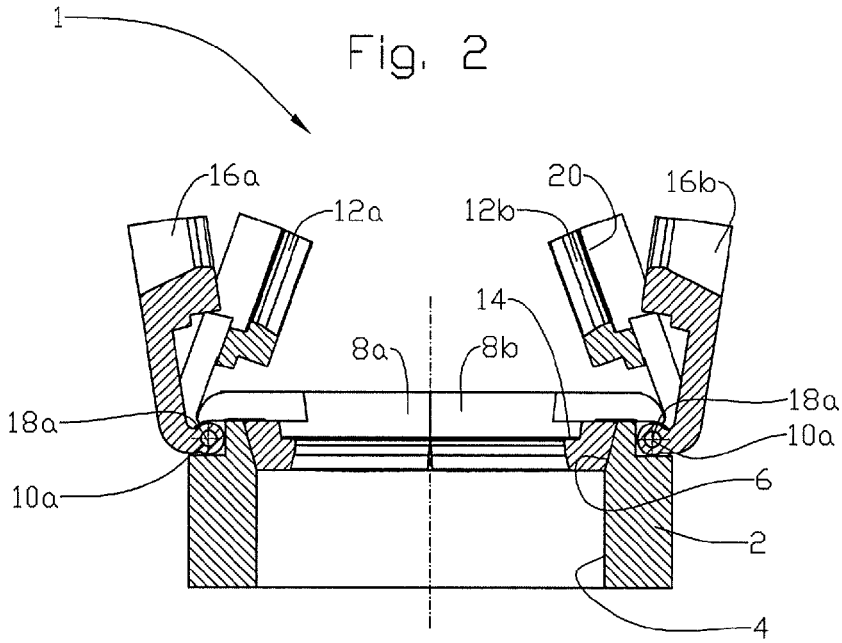
FIG. 3 shows a section II-II in FIG. 2.

The locking jaws 8*a* and 8*b* fits complementary in the conical portion 6 and constitute a locking ring in the elevator housing when they are in their active position as is shown in FIGS. 2 and 3.

A second set of locking jaws 12 comprises crescent-shaped locking jaws 12*a* and 12*b* also rotatable about the shafts 10*a* and 10*b*. The locking jaws 12*a* and 12*b* are designed having a smaller inside diameter than the locking jaws 8*a* and 8*b*.

Figure 4:
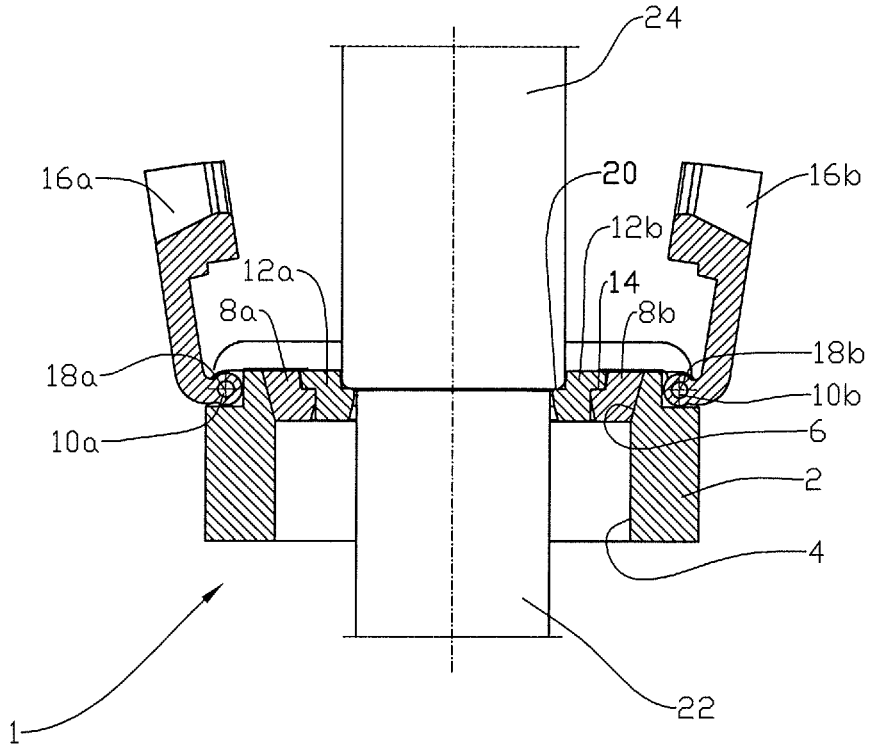
FIG. 4 shows the elevator connector connected to a pipe.

The locking jaws 12*a* and 12*b* belonging to the second set of locking jaws 12 fit in recesses 14 in the first set of locking jaws 8, see FIG. 4. When loaded the locking jaws 12*a* and 12*b* thus abut reliably against the underlying locking jaws 8*a* and 8*b*.

Correspondingly, a third set of locking jaws 16 comprising locking jaws 16*a* and 16*b* is designed having a smaller inside diameter than the locking jaws 12*a* and 12*b*. The locking jaws 16*a* and 16*b* are also hinged to the respective shafts 10*a* and 10*b* having central axes 18*a* and 18*b* respectively.

The locking jaws 16*a* and 16*b* belonging to the third set of locking jaws 16 fit in recesses 20 in the second set of locking jaws 12.

The locking jaws 8*a*, 8*b*, 12*a*, 12*b*, 16*a* and 16*b* are rotated between their respective active and inactive positions in a manner known per se by means of not shown actuators.

In FIG. 4 is shown a pipe 22 having a socket 24 positioned in the elevator connector 1. The first set of locking jaws 8 is in its active position. The pipe 22 has an intermediate size and the second set of locking jaws 12 are rotated to its active position to lock against the pipe socket 24 as is shown in FIG. 4.

Figure 5:
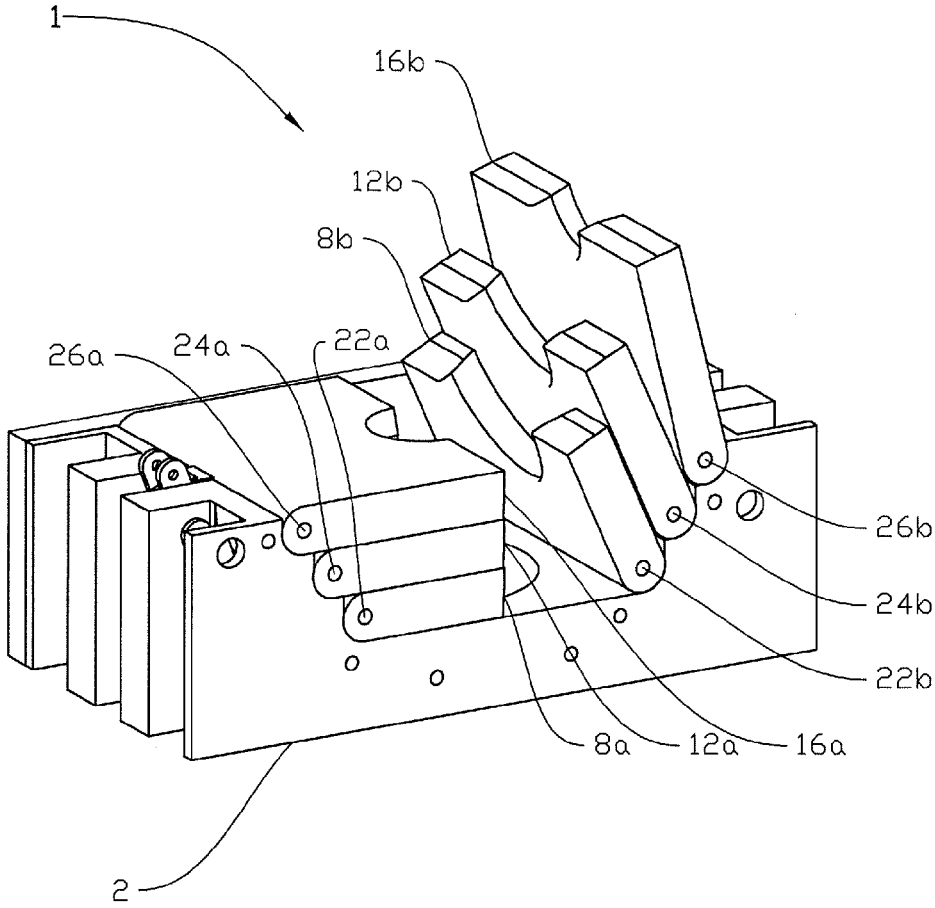
FIG. 5 is a perspective, schematic view of an alternative embodiment of a connector according to the invention.

In another embodiment shown in FIG. 5 different sets of locking jaws 8, 12, 16 are connected to separate not shown shafts on axes 22*a* and 22*b*, 24*a* and 24*b* and 26*a* and 26*b*, respectively. For illustrative purposes the locking jaws 8*a*, 12*a* and 16*a* are shown in active position, while the locking jaws 8*b*, 12*b*, and 16*b* are shown in inactive position.

The invention claimed is:

1. An elevator connector for lifting pipes, comprising:

an elevator housing having an internal bore adapted to receive a pipe passing therethrough, a pair of opposing shafts arranged perpendicular to an axis of the bore, the shafts arranged on opposite sides of an upper end of the elevator housing, a first pair of semi-circular locking jaws, each arranged to rotate about one of the shafts, the jaws being rotatable from a first, neutral position to a second, active position wherein the two semi-circular jaws abut to form a ring concentrically arranged within the internal bore, each of the jaws having an internal lip arranged to engage a socket on the pipe, a second pair of semi-circular locking jaws, each arranged to rotate about one of the shafts, the jaws being rotatable from a first, neutral position to a second, active position wherein the two semi-circular jaws of the second pair abut to form a ring concentrically arranged within the ring formed by the first pair of jaws when said first pair of jaws are in their active position, each of the jaws of the second pair having an internal lip arranged to engage a socket on the pipe, said second pair of jaws forming a ring of smaller diameter than the ring formed by the first pair of jaws, and further wherein the second set of jaws, in the active position, are arranged to abut and be supported by the lip of the first pair of jaws.

2. The elevator connector according to claim 1, further comprising a third or more sets of semicircular locking jaws having internal lips, each of the third or more sets being rotatable about the shafts to an active position wherein the jaws of each of the third or more sets of jaws form concentric rings arranged within the ring formed by a preceding set of jaws, each successive set of jaws in their active positions abutting and being supported by the lips of the preceding set of jaws.

3. The elevator connector according to claim 1, wherein the socket of the pipe to be lifted is a lip formed by an area of increased diameter of the pipe, the lips of the semi-circular jaws being arranged to engage the lip of the pipe when the jaws are in their active position.

4. An elevator connector for lifting pipes, comprising an elevator housing having an internal bore adapted to receive a pipe passing therethrough, a first pair of opposing shafts arranged perpendicular to an axis of the bore, the shafts arranged on opposite sides of an upper end of the elevator housing, a first pair of semi-circular locking jaws, each arranged to rotate about one of the first pair of shafts, the jaws being rotatable from a first, neutral position to a second, active position wherein the two semi-circular jaws abut to form a ring concentrically arranged within the internal bore, each of the jaws having an internal lip arranged to engage a socket on the pipe, a second pair of semi-circular locking jaws, each arranged to rotate about one of a second pair of shafts, the jaws being rotatable from a first, neutral position to a second, active position wherein the two semi-circular jaws of the second pair abut to form a ring concentrically arranged within the ring formed by the first pair of jaws when said first pair of jaws are in their active position, each of the jaws of the second pair having an internal lip arranged to engage a socket on the pipe, said second pair of jaws forming a ring of smaller diameter than the ring formed by the first pair of jaws, further wherein the second set of jaws, in the active position, are arranged to abut and be supported by the lip of the first pair of jaws.

5. The elevator connector according to claim 4, further comprising a third or more sets of semicircular locking jaws having internal lips, each of the third or more sets being rotatable about a third or more set of shafts respectively to an active position wherein the jaws of each of the third or more sets of jaws form concentric rings arranged within the ring formed by a preceding set of jaws, each successive set of jaws in their active positions abutting and being supported by the lips of the preceding set of jaws.

* * * * *